US005250105A

United States Patent [19]

Gomes et al.

[11] Patent Number: 5,250,105

[45] Date of Patent: Oct. 5, 1993

[54] SELECTIVE PROCESS FOR PRINTING CIRCUIT BOARD MANUFACTURING

[75] Inventors: José M. G. Gomes, Loures; Ana P. T. L. Rodrigues, Almada, both of Portugal

[73] Assignee: Eid-Empresa de Investigacao e Desenvolvimento de Electrónica S.A., Portugal

[21] Appl. No.: 653,342

[22] Filed: Feb. 8, 1991

[51] Int. Cl.[5] ..... B05D 3/10; B01J 23/58

[52] U.S. Cl. ..... 106/1.11; 106/1.28; 502/328; 502/330

[58] Field of Search ..... 106/1.11

[56] References Cited

U.S. PATENT DOCUMENTS 3,431,120 3/1969 Weisenberger ..... 106/1.26
3,798,050 3/1974 Franz et al. ..... 117/47 A
3,993,807 11/1976 Stabenow et al. ..... 427/229
4,019,910 4/1977 Mallory, Jr. ..... 106/1

*Primary Examiner*—Mark L. Bell
*Assistant Examiner*—Margaret Einsmann
*Attorney, Agent, or Firm*—Scully, Scott, Murphy & Presser

[57] ABSTRACT

A new family of palladium based metallization catalyst compositions is disclosed.

These catalysts are used in a process for the selective deposition of a metal on a substrate when a metallization mask (i.e. a plating resist) is used over the substrate.

Processes and compositions are also disclosed for manufacturing printed circuit boards, by using two metallization sequences, or one alone the latter comprising a so-called "selective process."

The process and composition are generally employed for the electroless plating of substrates, namely the metallization of plastics, ceramics, anodized aluminum and other materials.

4 Claims, No Drawings

SELECTIVE PROCESS FOR PRINTING CIRCUIT BOARD MANUFACTURING

BACKGROUND OF THE INVENTION

Processes for the formation of metallic layers over non-conducting substrates such as plastics and ceramics were known in the 1960's and consisted of applying a palladium catalyst to the substrate followed by electroless metallization.

The applications are naturally very diverse. Among them are the metallization of plastic articles such as automobile accessories, furniture, housewares, etc. or the manufacture of printed circuit boards and electromagnetic shields.

Typically, these procedures consist of the deposition of a thin layer of copper or electroless nickel over a previously catalyzed substrate, followed by reinforcement of the metallized layer through electrolytic plating. Deposition of only the electroless coating is generally referred to as the additive process whereas subsequent electrolytic plating is known as the semi-additive process.

There are today many variants, specifically for the manufacture of printed circuit boards, ("PCB's") that go from subtractive to completely additive methods. The subtractive method comprises removing a metal coating or layer from a non-metallic layer usually by etching the metal layer.

Several PCB's can be laminated to one another to form multilayer boards ("MLB's"). In MLB's the circuit of one board is connected to the circuit of one or more of the other boards in the multilayers. This is achieved by forming pads or circular areas of metal at a point or points on the conductive line or lines of the board. The pads may also be isolated from the conductive lines. The other board or boards that are to be connected are similarly provided with pads and in the laminating process the pads of the different boards are aligned over one another.

The MLB is then pressed and cured after which the pads of the MLB's are drilled to form through holes. The diameter of the drill is considerably less than the diameter of the pad, the ratio of diameters between the pad and the drill being about 2:1 or greater so that the overall structure comprises at a minimum a pad from one board aligned over a pad from another board with a through hole passing through them. Since the through hole in cross-section ideally presents a surface of alternating layers of the pads of the individual PCB's separated by the non-conductive base, an electrically conductive element has to be employed in the hole to form an electrical connection between the pads. This is done by a process known in the art as through hole plating (PTH).

PTH processes are also employed for connecting two metal conductive surfaces having a single non-conductive or dielectric board interposed between them for the formation of a PCB. Boards of this type and the formation of through holes in such boards are within the scope of the present invention and are intended to be included within the board definition of the PCB's as that term is used throughout the specification.

Before the PTH process can be undertaken, any "smear" in the hole must be removed.

After smear is removed, the through hole is plated. Electroless copper is employed as a PTH plating material. Standard electroless copper plating solutions known in the art are used for this purpose In order to promote the deposition of electroless copper on a non-conductive surface, the non-conductive surface is treated with a stannous chloride sensitizer solution followed by a super sensitizer solution of di-valent palladium chloride. The stannous chloride is oxidized to stannic chloride and the palladium chloride reduced to zero valent palladium.

A preferred method is to employ an activator comprising colloidal palladium containing stannous tin. Tin forms a protective colloid around the metallic palladium, and the solution implants a zero valent palladium site on the non-conductive surface for the purpose of initiating the deposition of the copper by chemical reduction. A post activator is then employed, generally an acid, to solubilize the protective colloid and expose the palladium.

The subsequently applied electroless copper coating solution contains metal ions, e.g. cupric ions and a reducing agent such as formaldehyde, which reduces the cupric ions in the solution to copper metal when in the presence of the palladium catalyst. The copper metal plates out on the surface of the through hole, making electrical contact with the walls of the metal pads in the through hole.

The board then goes to the "electrolytic" line where the copper deposit is reinforced, and an etch resist is applied (tin, tin-lead, gold, organic polymers, among others). Mask removal (stripping), etching, Sn/Pb reflow (if there is any) and final operations are the next steps.

After etching, additional processing may be employed including tin/lead removal, selective application of solder mask and selective application of solder through "hot air-levelling" or other similar methods.

In the metallization and image transfer processes, numerous variants have been tested with more or less success which include:

(a) Use of a colloidal copper based catalyst instead of palladium (LEA RONAL)

(b) Use of an ionic palladium catalyst without tin (SCHERING) (c) Use of an electroless copper solution that releases the "Accelerator" after catalysis with the classic mixed catalysts (SHIPLEY) (d) Hole metallization achieved in the electrolytic copper bath, through a modified preparation/catalysis in order to dispense with the electroless copper (EE-1 process of PCK, Morrissey et al. U.S. Pat. No. 4,683,036 and U.K. patent 2,123,036)

(e) Hole metallization achieved through colloidal carbon OLIN HUNT'S BLACK HOLE PROCESS)

However, most all the modifications and new procedures (the EE1 process being an exception) basically include the traditional approach which includes the basic steps of:

1 - Chemical Metallization

2 - Image Transfer

3 - Electrolytic Metallization

For many years, efforts have been made to develop ways in which the holes could be metallized after image transfer i.e. by a scheme of:

1 - Image Transfer

2 - Metallization

The difficulties of this process are two fold:

(a) The actual trend for the almost exclusive use of masks (plating-resists) developable in aqueous solution and removable in an alkaline aqueous environment, require that all the baths in the metallization sequence be acid (and not only those in the electrolytic metallization). This excludes the classic degreaser/conditioners as well as formaldehyde reduced electroless copper baths.

(b) The catalysts to be used must be selective in the sense that they must sensitize the surface of the holes, without sensitizing the surface of the mask.

None of the methods previously described allow such a selective process.

LEA RONAL, in collaboration with E.I. DU PONT DE NEMOURS & CO. INC., has developed a selective process restricted to semi-aqueous dry films, developable in solvents and removable in alkaline aqueous environment using electroless copper; however, the process was relatively complex, its application quite restrictive, and was thus put aside.

In 1989, the SCHLOTTER company introduced a selective process SLOTOPOSIT, characterized by using a preconditioning step (before image transfer) employing a gaseous phase containing $SO_3$, a reduction step after catalysis and an electroless step with nickel at a pH or about 5.5 at a temperature of 40° C. The process is compatible with all types of dry films, including those that are processed in an aqueous environment.

SUMMARY OF THE INVENTION

Accordingly, it is an object of the present invention to overcome these and other difficulties encountered in the prior art.

It is a further object of the present invention to provide a method and compositions for metallizing a non-conductive substrate which employs fewer processing steps than the methods of the prior art.

It is also an object of the present invention to provide a method and compositions for applying metal coatings to a non-conductive substrate by the basic steps of image transfer followed by metallization.

It is a further object of the present invention to provide a method and compositions for coating a non-metallic substrate by a selective process utilizing a coating mask and a catalyst that sensitizes the nonconductive substrate for subsequent application of metal coating compositions without sensitizing the surface of the mask.

It is a further object of the present invention to provide a method and compositions for applying a metal coating to a nonconductive substrate by a selective process that is not restricted to semi-aqueous dry film processes.

It is also an object of the present invention to provide a method and compositions for selectively coating a non-metallic substrate with metal coatings without employing highly corrosive compounds e.g. $S_3$.

These and other objects have been achieved according to the present invention which is more fully described in the specification and the claims that follow.

DETAILED DESCRIPTION OF THE INVENTION

The present invention comprises novel methods and compositions for preconditioning substrates for receiving catalysts as well as electroless metallization compositions, but is principally directed to novel catalyst compositions for applying a metal composition to a non-conductive substrate.

The present invention is directed both to a method and a composition for metallizing a nonmetallic substrate with a metal coating by combining a catalyst with the substrate where the catalyst is based on the oxides of a Group VIII noble metal from the Periodic Table of the Elements. The substrate is catalyzed in this way and an electroless or an electrolytic metal composition is then applied to the catalyzed substrate to form a metal coating on the substrate. It has been found according to the present invention that after catalyzation with the oxide of a Group VIII noble metal that subsequent coating by means of the metal composition is more readily effected where the oxide is reduced to a zero valent Group VIII noble metal. This reduction can be effected in several ways. Where the electroless coating also contains a reducing agent, the oxide of the Group VIII noble metal is reduced to a zero valent metal especially where the reducing agents are hypophosphites, borohydrides, hydrazines or amineboranes. Where the metal composition used to form a metal coating contains an aldehyde, some reduction of the oxide of the Group VIII noble metal is obtained, however, the more effective reducing agents are the aforementioned non-aldehyde materials. Additionally, some reduction of the oxide of the Group VIII noble metal will take place if an electrolytic metal composition is applied to the catalyzed substrate and the metal is electrolytically deposited.

Reduction can also be effected as a separate step i.e. subsequent to the application of the oxide of the Group VIII noble metal a chemical reducing agent can be applied to the catalyzed substrate especially those based on hypophosphites, borohydrides, hydrazines or amineboranes, and in some instances aldehydes or the various equivalents thereof. It is also possible to electrolytically reduce the catalyzed substrate by immersing it in an electrolytic bath as a cathode and applying an electric current through the bath in an art known manner.

One of the essential features of the invention is the discovery that the oxides of the Group VIII noble metals either do not adhere to a coating mask or are selectively applied to the non-metallic substrate such as a plastic substrate (e.g. circuit boards), ceramics or anodized aluminum surfaces to an overwhelmingly greater degree than to any coating mask that might also be present on such a substrate whereby any selective application of an electroless or an electrolytic metal coating to the substrate-coating mask structure results in substantially coating the non-metallic substrate whereby the coating mask is substantially uncoated with the metal composition.

It has been found that by employing the methods and compositions of the present invention that circuit boards, especially printed circuit boards optionally containing through holes can be plated in substantially a two step process of image transfer followed by metallization.

The Group VIII noble metals that are employed according to the present invention include Ru, Rh, Pd, Os, Ir and Pt, the preferred metals being Rh, Pd, Ir and Pt and especially Pd.

The novel catalyst of the present invention comprises a colloidal oxide of a Group VIII noble metal as described herein in combination with a lower molecular weight organic acid, a salt of a Group IA or Group IIA metal from the Periodic Table of the Elements said salt based on a lower molecular weight organic acid or a halogen acid and optionally, a non-ionic or anionic surfactant, nicotinic acid or hydrogen peroxide.

The invention also relates to a pre-rinse composition to be applied to a non-metallic substrate prior to applying the aforesaid catalyst and is based on a lower molecular weight organic acid, a Group IA or Group IIA metal salt of a lower molecular weight organic acid or a halogen acid and optionally a non-ionic or anionic surfactant, nicotinic acid, coumarine, adenine, guanidine or hydrogen peroxide.

A novel electroless coating composition has also been discovered according to the present invention and comprises a nickel salt in combination with a Group IA or Group IIA metal from the Periodic Table of the Elements and a lower molecular weight organic acid. The coating composition also contains an amineborane and a lead II or lead IV salt stabilizer.

The invention also relates to a novel solution for cleaning a non-metallic substrate comprising alkali or alkaline earth metal phosphates and alkali metal salt of EDTA in combination with various surfactants and a fluoride salt.

The various nonmetallic substrates that can be coated according to the present invention comprise plastic substrates, ceramic substrates and anodized aluminum. Specifically, some of the plastic materials that are coated according to the invention include circuit boards, especially printed circuit boards such as those comprising a non-conducting or dielectric base made up of a fibrous material such as glass fibers, paper and the like impregnated with a resinous material such as an epoxy resin or phenolic resin. These circuit boards are generally known in the art as rigid boards although flexible boards can also be coated according to the present invention and comprise thermoplastic dielectric layers such as fluorocarbon polymers, nylon polymers, polyimides, Kevlar (trademark) reinforced polymers, polyparabanic acids and polyesters. In addition to coating nonmetallic substrates based on the aforementioned materials whether dielectric boards or not, other polymers may be coated and include the polyolefins such as polyethylene, polypropylene and copolymers thereof, ABS polymers (acrylonitrile butadiene stryene polymers) and the like.

The metals that may be deposited by electroless coating methods comprise any metal that can be electroplated and especially nickel, copper, cobalt, gold or silver and the various alloys thereof. Where the electroless bath contains a hypophosphite reducing agent, alloys of the metal and phosphorus are also obtained, these types of alloys also being within the scope of the invention. In addition to gold and silver precious metal electroless coatings, other precious metals may be deposited including palladium, platinum and the like. Additionally, nickel-molybdenum-boron and nickel-tungsten-boron may be deposited which in some instances are employed as partial or complete replacements for gold in electronic applications. Cobalt-phosphorus and nickel-cobalt-phosphorus alloys can also be employed as the metal coating, these alloys having good magnetic properties and are useful in applications requiring such characteristics.

The catalyst of the present invention, as noted previously, also lends itself to the application of electrolytic coatings directly to the nonmetallic substrate that is treated with this catalyst either where the catalyst is reduced or is not reduced with a chemical reducing agent such as an amineborane. The direct electrolytic plating of the nonmetallic substrate treated with the catalyst of the present invention would be conducted in a manner similar to the EE-1 process of PCK and similar processes known in the art. Any metal that may be deposited electrolytically can be employed in either respect, such metals being well known in the art.

One of the advantages of the present invention is that it provides both a method and a composition for the application of a catalyst to a circuit board, especially a printed circuit board optionally having through holes by which it is intended that the invention can be applied to either circuit board either with or without such through holes.

Other additives can be employed to improve the coating and catalytic properties of the composition including nicotinic acid, or coumarine, adenine, guanidine and other compounds containing nitrogen bonded to carbon through single, double or triple bonds.

The various salts of the Group IA or Group IIA metal salts based on halogen acids that are employed in the composition of the present invention include the acids of fluorine, chlorine and bromine but not iodine.

As noted before, the chemical reducing agent employed according to the method and composition of the present invention include hypophosphites, borohydrides, hydrazines or amineboranes.

The hypophosphites that might be employed in this regard include the Group IA or Group IIA metal hypophosphites as these metals are defined herein.

The borohydrides include the Group IA, Group IIA, Group IIIA and transition metal borohydrides, organoamine borohydrides, cyanoborohydries, alkoxyborohydrides but especially, the Group IA and Group IIA borohydrides. Examples of these borohydrides include the following:

| |
|---|
| $LiBH_4$ |
| $NaBH_4$ |
| $KBH_4$ |
| $Be(BH_4)_2$ |
| $Mg(BH_4)_2$ |
| $Ca(BH_4)_2$ |
| $Zn(BH_4)_2$ |
| $Al(BH_4)_3$ |
| $Zr(BH_4)_4$ |
| $Th(BH_4)_4$ |
| $U(BH_4)_4$ |
| $(CH_3)_4NBH_4$ |
| $(C_2H_5)_4NBH_4$ |
| $(C_4H_9)_4NBH_4$ |
| $(C_8H_{17})_3CH_3NBH_4$ |
| $C_{16}H_{33}(CH_3)_3NBH_4$ |
| $NaBH_3CN$ |
| $NaBH(OCH_3)_3$ |

The hydrazines that may be used according to the invention have the formula:

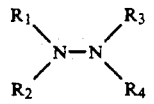

where $R_1$ is alkyl, cycloalkyl, aryl, alkaryl, aralkyl, alkoxy, aryloxy or nitrogen containing heterocyclic radical and $R_2$, $R_3$ and $R_4$ are hydrogen or the same as $R_1$, and at least one of $R_1$, $R_2$, $R_3$, $R_4$ is hydrogen, said alkyl radicals including the alkyl portion of the alkaryl radical, cycloalkyl are aralkyl and alkoxy radicals containing from one to about ten carbon atoms including the isomeric configurations thereof, the ring structure of said cycloalkyl, aryl, alkaryl, aralkyl, aryloxy and heterocyclic radicals containing from 3 to about 17 carbon atoms including fused ring structures.

The various hydrazines and hydrazine compounds that may be employed in this respect are further defined in Kirk-Othmer, *Encyclopedia of Chemical Technology,* Third. Ed., Volume 12 pp. 734–771 which is incorporated herein by reference.

The various amineboranes that may be employed according to the present invention comprise amine boranes having the formula:

$$R_{3-n}H_nBH_3$$

Monoaminoboranes of the formula:

$$R_2NBH_2$$

As well as bisaminoboranes of the formula:

$$(R_2)_2BH$$

Where R is alkyl, especially lower alkyl having up to about six carbon atoms, aryl or halo aryl or alkaryl or aralkyl where the alkyl group is a lower alkyl group as defined herein and the aryl group is especially one having six carbon atoms, examples of which include:

| |
|---|
| $(C_2H_5)_3N.BH_3$ |
| $(CH_3)_2NH.BH_3$ |
| tert-$BuNH_2BH_3$ |
| $C_6H_5(C_2H_5)_2N.BH_3$ |
| $C_5H_5N.BH_3$ |
| $(C_2H_5)_3N.BCl_3$ |
| $(p\text{-}BrC_6H_5)NH_2BCl_3$ |
| $(CH_3)_3N.BBr_3$ |
| $(C_2H_5)NH_2.BF_3$ |
| $(C_2H_2)_2NH.BF_3$ |
| $(C_2H_5)_3N.BF_3$ |
| $(CH_3)_2NH.BH_2Cl$ |
| $C_5H_5N.BH_2Cl$ |
| $(CH_3)_2NH.BH_2Br$ |
| $(CH_2)_2NH.BH_2I$ |
| $(CH_3)_3N.BHBr_2$ |
| $(CH_3)_3N.BHCl_2$ |
| $(C_2H_5)_2NH.B(CH_3)_3$ |
| $(CH_3)_2NH.B(tert\text{-}Bu)_3$ |

The lower molecular weight organic acid comprises those having from 1 to about 7 carbon atoms and can be either aliphatic or cyclic (e.g. aromatic acids) including the various isomers thereof. The especially preferred acids are those having up to about 3 carbon atoms.

The Group IA or Group IIA metal salts preferably comprise those based on lithium, sodium, potassium, magnesium, calcium, strontium and barium, especially sodium potassium and calcium. As noted previously, the catalyst may optionally contain a non-ionic or anionic surfactant.

The various anionic surfactants suitable in this respect comprise:

Carboxylates based on straight chain carboxylic acids having from about 9 to about 21 carbon atoms in combination with a metal ion or ammonium ion;

Polyalkoxycarboxylates prepared by the reaction of chloroacetate with an alcohol ethoxylate or an acrylic ester and an alcohol alkoxylate;

N-acylsarcosinates;

Acylated protein hydrolysates;

Sulfonates comprising alkyl, aryl or alkaryl sulfonates;

Lignosulfonates;

Naphthalene sulfonates;

Alpha-olefin sulfonates;

Petroleum sulfonates;

Dialkyl sulfosuccinates;

Amido sulfonates (N-Acyl-N-Alkyltaurates);

2-Sulfoethyl esters of fatty acids (acyl isethionates);

Ethoxylated and sulfated alcohols;

Ethoxylated and sulfated alkylphenols (sulfated alkylphenol ethoxylates);

Sulfated alkanolamides and sulfated triglycerides;

Sulfated natural oils and fats;

Phosphate esters.

The nonionic surfactants that may be employed include:

Polyoxyethylene surfactants (ethoxylates);

Alcohol ethoxylates;

Alkylphenol ethoxylates;

Carboxylic acid esters of polyols and the terminal hydroxyl groups of ethylene oxide chains;

Mono-and diglycerides of saturated fatty acids;

Polyoxyethylene esters of fatty acids and aliphatic carboxylic acids;

Anhydrosorbitol esters of fatty acids;

Ethoxylated anhydrosorbitol esters of fatty acids;

Ethoxylated natural fats, oils and waxes;

Glycol esters of fatty acids;

Condensation products of fatty acids and hydroxyethyl amines;

Distearoyl amine condensates of fatty acids (fatty acid diethanolamides);

Monoalkanolamine condensates of fatty acids;

Polyoxyethylene fatty acid amides;

Polyalkylene oxide block copolymers;

Poly(oxyethylene)-co-oxypropylene.

The amphoteric surfactants include those such as:

Alkyltrimethylammonium salts;

Alkylpyridinium halides;

Imidazolinium derivatives prepared from the two-alkyl-1-(2)-hydroxyethyl-2-imidazolines and sodium chloroacetate;

Alkylbetaines;

Amidopropylbetaines.

The foregoing surfactants falling within the above definitions are described in greater detail in Kirk-Othmer, *Encyclopedia of Chemical Technology,* Third Edition, Vol. 22, pp. 332–432 which is incorporated herein by reference.

The process of the present invention also surpasses particularly, the main inconvenience of the SLOTOPOSIT, which is the pre-conditioning that occurs in the presence of an extremely aggressive gas, ($SO_3$) the latter being essentially a batch operation difficult to run as a continuous process.

Contrary to mixed catalysts containing tin and palladium, the catalysts of the present invention only contain palladium compounds and are free of tin.

The new catalysts can be prepared in several ways, beginning with several palladium compounds. Some preparation methods are more adapted to laboratory work, and others more adapted to industrial scale manufacturing processes. The catalysts can be applied to any of a variety of substrates by methods known in the art such as dipping (i.e. immersion coating) spray coating, roller coating and the like.

The following examples are illustrative.

EXAMPLE 1

$PdCl_2$ is dissolved in a hot solution containing NaCl. After palladium chloride has dissolved, sodium acetate is added. This is followed by a heating from room temperature up to 90° C.

The concentration of the components of the catalyst may vary within wide ranges, as follows:

| | |
|---|---|
| $PdCl_2$ | from about 0.05 to about 1 g/l |
| NaCl | from about 1 to about 100 g/l |
| $NaCH_3COO$ | from about 0.5 to about 100 g/l |

During heating, the solution acquires a brown-reddish color, its preparation time varying from one minute (at 90° C.) up to 24 hours (at room temperature). The pH is adjusted with acetic acid to a value from about 3.5 to about 6.0.

A good example of a catalyst composition within this family of catalysts is as follows:

| | |
|---|---|
| $PdCl_2$ | 0.25 g/l |
| NaCl | 10 g/l |
| $NaCH_3COO$ | 15 g/l |
| Heating | 50° C. for 10 min. |
| pH | 4.9 adjusted with acetic acid |

In applying this catalyst composition (as well as the other catalyst compositions of the invention) to a substrate, the composition can be maintained at a temperature from about room temperature (20° C.) up to about 60° C., especially about 40° C. whereas the substrate may be contacted with the composition from about one minute to about 20 minutes, and especially about 2 minutes.

To avoid drag-in from previous solutions, particularly rinse waters, it is recommended that the substrate to which the catalyst is applied be contacted by a "pre-dip" composition in a solution with the same composition, but without palladium. For this particular catalyst, the "pre-dip" composition used will have the following formula:

| | |
|---|---|
| NaCl | 10 g/l |
| $NaCH_3COO$ | 15 g/l |
| pH | 4.9 adjusted with acetic acid |

This "pre-dip" composition, as is the case with the catalyst compositions, can be applied to the substrate by dipping, spray coating or roller coating, the method of application of the "pre-dip" composition not being limited by referring to it as a "pre-dip" composition.

EXAMPLE 2

The catalysts of this example are also prepared from palladium chloride, however, the catalyst solution is first prepared as a concentrate, the recommended ranges of concentrations, times, temperatures and pH for the catalyst composition being the same as shown in Example 1.

An example of a catalyst composition in this respect is as follows:

| | |
|---|---|
| $PdCl_2$ | 0.25 g/l |
| NaCl | 1.5 g/l |

-continued

| | |
|---|---|
| $NaCH_3COO$ | 20 g/l |

The three ingredients are dissolved in agitating water at a temperature of 55° C. The solution remains at these conditions for 16 hours. Heating is interrupted and the solution's pH is lowered to 4.9 with $HCH_3COO$.

After cooling to room temperature, the precipitate formed is allowed to settle. The solution is then carefully poured off or decanted to save the precipitate and a part of the solution. The portion that is saved may easily vary between less than about 1% up to about 100% of the initial volume. The use of ⅛ of the initial volume is recommended, so that the concentrate preparation won't become very critical and so that a high palladium concentration remains in it. Therefore, if for example, 1 liter of solution has been prepared, after decanting, the volume of the precipitate plus the remaining solution is 125 ml.

After the concentrate is ready, the catalyst solution is prepared by combining the following components:

| | |
|---|---|
| Concentrate (prepared as above) | about 12.5 ml/l to about 500 ml/l |
| $NaCH_3COO$ | 0 to about 100 g/l |
| pH (adjusted with $HCH_3COO$) | about 3.5 to about 6.0 |

The preferred composition has the following components:

| | |
|---|---|
| Concentrate | 125 ml/l |
| $NaCH_3COO$ | 17.5 g/l |
| pH (adjusted with $HCH_3COO$) | 4.5 |

The catalyst must be prepared under agitation. After the above solution becomes homogeneous the pH is adjusted to 4.5 with acetic acid.

As is the case with the catalysts of Example 1, these catalysts work well under wide ranges of temperatures and immersion or contact times, however, it is preferred to use room temperatures (about 20° C.) and contact times of about 15 minutes.

As in Example 1, the "pre-dip" solution contains the same ingredients as the catalyst, with the exception of palladium salts and is applied to the substrate, as is the catalyst in the same way as in Example 1. As an example, the "pre-dip" solution of this example can have the following composition:

| | |
|---|---|
| NaCl | 1.25 g/l |
| $NaCH_3COO$ | about 20 g/l |
| pH (adjusted with $HCH_3COO$) | 4.5 |

EXAMPLE 3

The catalysts of this example are prepared from palladium acetate. It is possible to prepare the catalyst directly, without going through any concentrate, as was shown in Example 1, with $PdCl_2$. An industrial scale manufacturing process in which the catalyst is prepared and maintained from a concentrate is of special interest, and will be described for this reason.

Preparation of the Concentrate

The concentrate is prepared by combining from about 0.1 to about 15 g/l and especially about 3.16 g/l of palladium acetate with from about 0.5 to about 150 g/l and especially about 50 g/l of sodium acetate.

The sodium acetate is dissolved in distilled or deionized water and palladium acetate is added to the solution under agitation.

As was stated in Example 1, preparation time varies according to temperature, the time varying from about 30 minutes to about 24 hours and especially about 5 hours whereas the temperature will vary from about room temperature (20° C.) to about 90° C. and especially about 55° C.

After preparation, the pH is adjusted from the initial value to 3.5 with acetic acid. The final preferred pH for the concentrate is 5.0.

Catalyst Preparation from the Concentrate

The foregoing concentrate is used for preparing a catalyst by employing anywhere from about 10 to about 950 ml/l of this concentrate with from 0 to about 100 g/l of sodium acetate and adjusting the pH to a value of from about 3.5 to about 6.5. The catalysts can be used to contact a substrate at temperatures from about room temperature (20° C.) up to about 60° C., the contact time being a minimum of about one-half minute.

Two optimized formulations of the foregoing catalysts have been developed from the catalyst concentration of Example 3 and are as follows:

| | |
|---|---|
| FORMULA 1 | |
| Concentrate of Example 3 | about 50 to about 150 ml/l |
| $NaCH_3COO$ | about 0 to about 20 g/l |
| pH (adjusted with acetic acid) | about 4.5 to about 4.9 |
| Temperature | about 40° C. |
| Contact time | about 1 to about 10 min |
| FORMULA 2 | |
| Concentrate of Example 3 | about 50 to about 150 ml/l |
| pH (adjusted with acetic acid) | about 4.3 to about 4.6 |
| Temperature | about 20° C. |
| Contact time | about 1 to about 10 min |

Formula 2 is considered the optimum for manufacturing conditions.

The "pre-dip" solution for the foregoing catalysts are prepared in the manner as described previously i.e. by omitting the catalyst salt from the composition. Thus, the "pre-dip" solution for the catalysts of this example can have a concentration anywhere from about 2.5 to about 7.5 g/l and the pH is adjusted with acetic acid to anywhere from about 4.3 to about 4.6.

ADDITION OF OTHER SUBSTANCES TO THE FORMULAS IN THE EXAMPLES

A wide variety of compounds can be added to the catalysts and concentrates described in Examples 1-3 without significantly altering their characteristics, performance and catalysis mechanism.

Among the possible substances, only a few are cited: many anionics and non-ionic (but not cationics) surfactants, coumarine, nicotinic acid, adenine, guanidine and compounds containing nitrogen bonded to carbon through single bonds (e.g. piperidine, gramine or tryptamine and the like), double bonds (e.g. pyridine, papaverine, caffeine or folic acid and the like) or triple bonds such as alkyl cyanides and especially lower alkyl cyanides where the alkyl group is a straight chain or a branched chain, the lower alkyl radical containing up to about 8 carbon atoms (e.g. acetonitrile and the like).

The addition of hydrogen peroxide ($H_2O_2$) is highly recommended in commercial operations. It is usually added once every 2 or 4 weeks to the catalyst and/or the "pre-dip" solution in an amount of about 5 ml/l where the concentration of the hydrogen peroxide is 1.5g/l.

Absolute purity of $H_2O_2$ is required, since hydrogen peroxide stabilized with $Sn^{2+}$ and $Sn^{4+}$ is frequently found, and such ions are not tolerated in the mentioned catalyst or concentrate.

Air agitation can be used in lieu of or in addition to $H_2O_2$ addition.

Other examples of substances that should not be added to the catalyst or concentrate are hydrochloric, sulfuric and nitric acids (even though they may be tolerated in small concentrations).

CHARACTERIZATION OF THE NEW SELECTIVE CATALYST DEFINITION OF SELECTIVITY

The process and/or selective catalyst is defined as one that conforms overall to the following conditions:

1 - It allows one or more sequential metallic plating on chosen and pre-determined areas of the substrate.

2 - The areas of the substrate which are to be free of this deposit, are covered with a plating-resist mask, that can be a liquid photoresist, a dry film photoresist, or a screen-printing ink.

3 - Between catalysis and plating of one or more metallic deposits, there is no interruption in the process, or removal of the plating-resist mask. Consequently, the plating-resist is present at least, from the beginning of catalysis and the end of the desired metallic plating.

4 - The procedure is compatible with all the previously noted plating-resists families, such as dry film photoresist, liquid photoresists and screen printing inks. This includes plating resists that are entirely processable in aqueous solutions, that is, those that are developable and strippable in aqueous solutions.

EVIDENCE OF SELECTIVITY

All the catalysts described possess selective characteristics They are able to sensitize various substrates (e.g.: epoxy resin glass fiber composites, the whole range of thermoplastic and thermosetting resins and ceramics, whose surfaces have been adequately prepared) but do not sensitize the plating-resist surfaces mentioned herein. Selectivity occurs because of a metallic deposition (via electroless deposition, a combined electroless-electrolytic deposition or electrolytic deposition) over previously sensitized areas, and the absence of deposition over areas covered by the plating-resist. As stated before, this occurs without removal of the plating-resist between catalysis and the completion of the metal deposition process.

Through X-ray Photoelectronic Spectroscopy (XPS) techniques, it is possible to establish differences between the new and mixed catalysts, as well as understand the reasons for selectivity.

Example A:

-continued

| | |
|---|---|
| Catalyst concentrate from Example 3 | about 50 to about 150 ml/l |
| Sodium fluoride | about 0.2-to about 1 g/l |
| Nicotinic acid | about 5-to about 10 mg/l |
| pH (adjusted with acetic acid) | about 4.3 to about 4.6 |
| Temperature | about room (about 20° C.) |
| Immersion time | about 2 to about 5 min. |
| Example B: | |
| Catalyst concentrate from Example 3 | about 50 to about 150 ml/l |
| Non-ionic surfactant octylphenol with 40 ethoxy units (e.g. Rhom and Haas TRITON X-405) | about 0.1 to about 1.5 ml/l |
| pH (adjusted with acetic acid) | about 4.3 to about 4.6 |
| Temperature | Room (about 20° C.) |
| Immersion time | about 2 to about 5 min. |

ESCA-XPS analysis of catalyzed substrates with the catalysts

FR-4 was the substrate used which is a laminate for printed circuit boards described in NEMA LI-1/75. RISTON (trademark, E.I. DU PONT DE NEMOURS & CO.) 3615 was chosen as the plating resist. The catalyzed samples were prepared by degreasing and conditioning the substrate with the "Degreaser/Conditioner" as described subsequently herein and based on sodium polyphosphate and the other components of the formulation, again as set forth subsequently herein. The substrate was then immersed in a "pre-dip" water solution of sodium acetate (5 g/l) adjusted to a pH of 4.5 with acetic acid for about one minute. The substrate was then removed from the pre-dip solution and immersed in a catalyst solution. The catalyst was prepared from a concentrate containing 3.1 g/l palladium acetate and 50 g/l sodium acetate according to Example 3. This concentrate was then diluted with distilled water to a concentration of 100 ml/l and the pH adjusted to 4.50 with acetic acid to form a catalyst. The substrate was then immersed in this catalyst at room temperature (20° C.) for a period of five minutes after which the substrate was withdrawn from the catalyst and rinsed with distilled water for one minute.

In FIG. 5 and 6 the comparison between XPS spectra of the FR-4 substrate before and after catalysis is shown (wide scanning). The detectable differences are shown by the Pd peeks and appearance of fluoride traces (caused by the use of ammonium bifluoride in the degreaser/conditioner).

A detailed analysis of the peeks due to the 3d electrons of Pd was performed over the FR-4 substrate as well as over the dry film surface, between 330 and 350 eV.

After corrections where made due to electrization of the sample, the following binding energies were determined:

| | |
|---|---|
| FR-4 substrate | −337.7 eV |
| dry film | −335.8 eV |

As a word of explanation, the binding energies were obtained from the XPS spectra through computer processing. The tested samples were electrically nonconductive (glass/epoxy substrates with or without a photoresist). XPS involves the irradiation of the sample with X-rays and measurement of the energies of the liberated photoelectrons. Because electrons carry a negative charge, this charge tends to accumulate at the surface of the non-conductive sample and this changes the energy of the following photoelectrons. Because of this accumulation of charge at the surface, a correction must be made as to the measured binding energies to take this into account.

There is no evidence of metallic Pd on any of the surfaces. The method of the Auger parameter was applied for both surfaces. It confirms the non-metallic characteristics of the existing palladium. The Auger parameter method is a "double check" for the binding energies. In this case, it consists in measuring the energy differences between the Pd 3d ESCA lines and the respective Pd Auger peak. These additional determinations confirm the nonmetallic state of Pd and a shift corresponding to $PdO_2$.

The binding energy over the FR-4 substrate adjusts itself to the 337.6 ev value that corresponds to $PdO_2$. On the surface of the dry film, the binding energy of Pd does not adjust to any listed in the PHI-handbook nor in the well-known handbook of Briggs and Seah, *Practical Surface Analysis by Auger Electron Spectroscopy and Photoelectron Spectroscopy,* John Wiley & Sons, Chichester, New York, 1985.

The evidence presented is coherent with an oxidation state of Pd inferior to +4, but does not adjust perfectly to the 336.1 ev value for PdO.

In the present state of knowledge, it can be stated that over the surface of the photo-resist, Pd is most likely a mixture of PdO and $PdO_2$, with more PdO present than $PdO_2$. The following results were obtained after a quantitative analysis:

| | |
|---|---|
| Pd concentration over FR-4 | 6.0–8.2% (atomic percent) |
| Pd concentration over photo-resist RISTON (trademark) 3615 | 1.1–2.3% (atomic percent) |

For reference, the same substrates catalyzed with a conventional Pd/Sn mixed catalyst comprising Shipley CATAPOSIT 44 (trademark) working at 50° C at a concentration of 3% and utilizing an immersion time of about 3 minutes. The following results were obtained:

| | |
|---|---|
| Pd concentration over FR-4 | about 6% (atomic percent) |
| Pd concentration over photo-resist RISTON (trademark) 3615 | about 15% (atomic percent) |

The following conclusions have been drawn from the observations:

1 - Palladium adsorbed on the surfaces of the substrate and on the plating-resist mask can not be found in the metallic state.

2 - There is Pd adsorption on the surface of the plating resist.

3 - Contrary to a mixed catalyst (non-selective), the new catalysts places 5 times more Pd on the substrate, than on the dry film mask (atomic percent of about 5:1 against 6:15 with a mixed catalyst).

4 - There is an obvious chemical difference between the species adsorbed on the surface of the substrate and those adsorbed on the mask. However, no differences can be found with a mixed catalyst.

These conclusions remain qualitatively the same when conditions vary (immersion times, temperatures, etc.), even though small quantitative alterations may occur.

The selective nature of the new catalysts is thus, unequivocally supported.

USE OF THE NEW CATALYST ON CHEMICAL METALLIZATION LINES

As noted, the PTH method is a metallization process involving a set of operations that lead to coating the through holes of a PCB with a metallic deposit (usually copper). These operations occur between drilling and image transfer.

Even without using the true selective potential of this invention, the catalyst set forth in the Examples can be used with advantage. Thus the new catalysts where used in conventional and traditional sequences and methods do in fact introduce very significant changes.

Table 8 shows the comparison between the traditional process, which uses a mixed catalyst (PROCESS 1), the RONAMET (trademark, Lea-Ronal) process (PROCESS 2) and 3 other distinct processes (PROCESSES 3-5) which use the new family of catalysts.

Referring to Table 8, the times involved in PROCESSES 3-5 are equal or inferior to processes 1 and 2. They also have the advantage of involving a smaller number of operations (12 vs 14). Nevertheless, the new catalyst (step 7 in PROCESSES 3-5) offers other advantages that are not apparent from Table 8.

Again referring to Table 8, the fact that the catalysts of the present invention work at a pH between 4 and 5 as compared to a pH $<1$ in PROCESS 1 and at a pH 3.5 in PROCESS 2, makes the affluent treatment easier. Furthermore, the new catalyst lasts for a long period, as much as a mixed conventional catalyst. Similarly important, is the ability to work with a catalyst free from chlorides, with a mild pH, which eliminates the possibility of attack cf silanes. These silanes are the bonding agents between the resin and the glass fibers in epoxy composites. The "back plating" problem that appears in very dense circuits with small hole diameters is thus, eliminated.

Back-plating is caused by highly acidic catalyst which tend to destroy the ether bond formed between the silane and the glass fiber. A capillary is formed along the length of the individual fibers which allows the catalyst then to penetrate down the capillary and palladium seed crystals are carried into the inside of the material of the circuit board and with the catalyst seed in place, immersion in an electroless copper solution will allow the copper to plate not only on the surface of the circuit board but also considerably beneath the surface.

This is especially a problem in through hole plating in circuit boards which have a great number of through holes in a given area i.e. "high density" through holes, since the likelihood of forming electroless copper interconnections, i.e. short circuits, between the through holes is increased.

TABLE 8

COMPARISON BETWEEN 5 PROCESSES OF "CHEMICAL METALLIZATION" OF CIRCUIT BOARDS

| PROCESS 1 | PROCESS 2 | PROCESS 3 | PROCESS 4 | PROCESS 5 | |
|---|---|---|---|---|---|
| Degreaser/Conditioner | Ronacat Cleaner | Degreaser/Conditioner | Degreaser/Conditioner | Degreaser/Conditioner | 1 |
| Rinse | Rinse | Rinse | Rinse | Rinse | 2 |
| Rinse | Rinse | Rinse | Rinse | Rinse | 3 |
| Microtech | Ronacat Microtech | Microtech | Microtech | Microtech | 4 |
| Rinse | Rinse | Rinse | Rinse | Rinse | 5 |
| Preparation for Catalysis | Ronacat Activator | Preparation for Catalysis | Preparation for Catalysis | Preparation for Catalysis | 6 |
| Catalysis (Sn/Pd) | Rinse | Catalysis (Pd) | Catalysis (Pd) | Catalysis (Pd) | 7 |
| Rinse | Ronacat Catalyst | Rinse | Rinse | Rinse | 8 |
| Rinse | Rinse | Electroless Nickel | Reduction to Pd* | Pd* Reduction/ Conditioner | 9 |
| Accelerator | Rinse | Rinse | Rinse | Rinse | 10 |
| Rinse | Ronacat Stripper | Electroless or Electrolytic Copper | Electroless Copper | Electrolytic Copper | 11 |
| Rinse | Rinse | Rinse | Rinse | Rinse | 12 |
| Electroless Copper | Ronadep 100 | | | | 13 |
| Rinse | Rinse | | | | 14 |
| N. of total operta. - 14 Usual time to obtain a Cu thickness of about 2.5μ-50 min | N. of total operta. - 14 Usual time to obtain a Cu thickness of about 2.5μ-65 min | N. of total operta. - 12 Usual time to obtain a Cu thickness of about 2.5μ 1) with electroless copper - 47 min 2) with electrolytic copper - 26 min | N. of total operta. - 12 Usual time to obtain a Cu thickness of about 2.5μ-44 min. | N. of total operta. - 12 Usual time to obtain a Cu thickness of about 2.5μ-31 min. | |

COMMON CONDITIONS FOR PROCESSES 3-5 IN TABLE 8

Degreasing/conditioning operations (step 1) and Microetch (step 4) can be performed with any current products on the market. To name a few examples, step 1 could employ Shipley's Cleaner/Conditioner 231, and step 4 LEA RONAL's Ronetech PS (based on persulphate) or Shipley's Pre-Etch 746 (based on $H_2SO_4$/-$H_2O_2$). Naturally, immersion times and temperatures (including rinses) must always be performed according to the type of products and supplier recommendations.

"Preparation for Catalysis" (step 6) and "Catalysis" (step 7) operations are always performed with any of the catalysts mentioned in Example 3 or any of its derivatives. Time calculation was performed admitting an immersion time of 1 min. in step 6 and a catalysis time of 4 min (e.g. using FORMULA 2 of Example 3).

COMMON CONDITIONS FOR PROCESSES 3 AND 4 IN TABLE 8

The electroless copper deposition (step 11), can be performed with any solutions available in the market.

Obviously, baths with high deposition rates are preferred, because they allow production in baskets, rather than in suspensions (that would be the case if an electrolytic flash were used). It is clear that the electroless copper solutions from Table 8 operate with formaldehyde as the reducing agent in an alkaline environment. The new catalyst is not completely efficient for starting an electroless deposition in formaldehyde reduced baths, unless there is a previous reduction to Pd° of the adsorbed palladium compound.

In PROCESS 3 this previous reduction is not employed. In such conditions, the first electroless metallization (step 9) must be performed in baths reduced with hypophosphite, borohydride, hydrazine, alkylamineboranes or its derivatives. The Ni, Co, Au and Ag electroless solutions, fit totally or partially into these categories. Ni, is obviously the best choice, as it works with the mentioned reducers in a wide range of pH's. The reducing agents in these baths, appears to effect a reduction of the palladium compound to Pd°.

All costs considered, the best approach is the use of hypophosphite reduced electroless Ni, at a mild acid pH (4–5) or alkaline (8–10). Provisions that require low temperatures and other conditions that lead to low concentrations of co-deposited phosphorus are obviously preferred.

There are many scientific papers and patents on electroless nickel, where these problems have been thoroughly explained.

One example of an alkaline Ni/P among the many successful formulations tested is as follows:

| | | |
|---|---|---|
| $NiCl_2.6H_2O$ | 30 g/l | Air agitation |
| Sodium citrate | 100 g/l | Continuous filtration |
| Ammonium chloride | 20 g/l | Temp. −50–80° |
| Sodium Tetraborate | 15 g/l | |
| Sodium Hypophosphite | 30 g/l | |
| Purified Acacia gum | 2 g/l | |
| 2-ethyl-hexyl-sodium sulfate (40%) | 0.5 ml/l | |
| pH (adjusted with ammonia) | 8–10 | |

In process 3, there is no need for an activation step between electroless nickel and electroless or electrolytic copper. All is needed is a one minute rinse in tap water.

The activation between electroless copper and copper has not been included, only a 1 minute rinse in tap water. There are no adhesion problems between Ni and laminated copper, nor between deposited copper and Ni. The much feared passivation of electroless Ni, does not occur, even when the circuit boards were submitted to violent peeling and thermal shock tests, with the exception of some electroless Ni/P at high temperatures ( 90° C), and some borohydride based baths. In those cases, there were small adhesion problems. Therefore, compatibility testing must be performed when using certain electroless nickels.

Even though Ni-P formulations lead to excellent metallization results, one must not forget that after an immersion time of one minute a continuous homogeneous layer of Ni begins to form over the laminated copper. This Ni layer can be only 0.1μ thick but it is sufficient to prevent copper removal during ammoniacal etching. This is the main reason why the use of electroless Ni, instead of electroless Cu, has never become very popular in the chemical line. This problem can be overcome by the use of any of the electroless Ni formulations set forth herein as "Hypophosphite Reduced Electroless Nickel." (infra). With these baths, nickel deposition over the copper laminate (e.g. the area of the PCB other than the through holes) is so insignificant, even with immersion times of 30 minutes, that there is no difficulty in removing copper with the usual etching solutions, namely ammoniacal. This aspect is also a remarkable innovation.

It is important to note that the foregoing condition are also applicable where a conventional catalyst is used (e.g. an Sn/Pd mixed catalyst).

PROCESS 4 allows the reduction of palladium compound to Pd° and any formaldehyde reduced electroless copper responds to catalyzed areas.

The reduction can be chemical reduction effected by means of a solution prepared from hydroazine, hypophosphite, borohydride, alkylamineboranes and its derivatives, within large concentration ranges, working temperatures, immersion times and pH. In fact, this step is not very critical, because it's very easy to reduce Pd(IV) or Pd(II) to Pd°. The following is an example of a reduction solution that can be employed in this regard:

| | | |
|---|---|---|
| Dimethylamineborane: | Range | about 1 to about 40 g/l |
| | Preferred | about 5 g/l |
| Temperature | | about Room (20° C.) |
| Immersion time | | about 1 to about 2 min. |

Reduction to Pd° is almost instantaneous, and if desired, surfactants (as defined herein) can be added and/or the pH adjusted in the range of about 4.0 to about 13.0.

Borohydride and/or hydrazine based reduction solutions also work at room temperature.

The following hot reduction is recommended with sodium hypophosphite:

| | | |
|---|---|---|
| Sodium Hypophosphite: | Range | about 5 to about 100 g/l |
| | Preferred | about 30 g/l |
| Temperature | Preferred | about 30 to about 90° C. |
| | | about 50 to about 60° C. |
| Immersion time | | about 1 to about 5 min. |
| pH | | about 4.5 to about 10 |

CONDITIONS FOR PROCESS 5 IN TABLE 8

PROCESS 5 does not use any electroless solutions after catalysis in order to obtain hole metallization. This process is somewhat similar to EE1 Process covered by patents to Kollmorgen Technologies (Morrissey et al., U.S. Pat. No. 4,683,036 and U.K. patent 3,123,036).

Even though the EE1 is based on Sn/Pd mixed catalysts, it should be considered as background for PROCESS 5.

After catalysis, there is a Pd° reduction in a "Conditioner" which contains thiourea or a derivative, such as the following formulation:

| | | |
|---|---|---|
| Dimethylamineborane | about 2 to about 50 g/l | (10 g/l) |
| Thiourea | about 5 to about 50 g/l | (25 g/l) |
| Triton X-100 | about 0 to about 20 ml/l | (10 ml/l) |
| pH | about 7 to about 12 | (9–10) |
| Temperature | about Room Temp. (20° C.) | |
| Immersion time | about 2 to about 15 min. | (5 min.) |

The preferred values are shown in parentheses. Obviously, dimethylamineborane can be substituted with any of the other reduction agents referred to previously.

After immersion in the acid electrolytic copper, the applied voltage must range from about 0.8 to about 1.1 V for about 3 to about 4 minutes. After this, the holes should be metallized and copper plating may be performed at a conventional current density for this process.

The tolerance of acid copper baths to the thiourea varies. The use of two electrolytic copper steps, separated by a rinse is recommended. The first step is for hole metallization (about 3 to about 4 minutes) and the second for reinforcement of the copper layer. Any time a bath has been contaminated with thiourea, it must be decontaminated or a substitute both employed.

USES FOR THE NEW CATALYST IN THE CHEMICAL METALLIZATION LINE

The new catalysts can be used in other combinations, always following conventional circuit board chemical metallization. One such combination combines the use of a reducer with electroless nickel. In fact, not all electroless nickel solutions perform equally well with the new catalyst. By using a reducer (as described in step 9 of PROCESS 4) the process becomes compatible with all electroless nickel baths. Under these conditions (at least with printed circuit boards) the use of a copper deposit, performed via electroless or electrolytic, is indispensable. Another combination uses the new catalyst (with or without a reducer) combined with hypophosphite reduced electroless copper. In this way, chemical metallization is reduced to 10 steps as shown in Table 9.

TABLE 9

Chemical metallization sequence using the new catalyst and a hypophosphite reduced electroless copper.

| | |
|---|---|
| 1. | Degreasing/Conditioning |
| 2. | Rinse |
| 3. | Rinse |
| 4. | Microtech |
| 5. | Rinse |
| 6. | Preparation for catalysis |
| 7. | Catalysis |
| 8. | Rinse |
| 9. | Electroless copper (hypophosphite reduced) |
| 10. | Rinse |

THE NOVEL SELECTIVE METALLIZATION PROCESS

The traditional process used for manufacturing printed circuit boards (considering all its variants) is well developed and widely used but has several disadvantages. One disadvantage is the use of two metallization lines, which compared to the new process means a bigger investment, the growing use of hand-labor, more frequent manipulation during the manufacturing cycle (quality) and longer processing times.

There are also problems associated with aging and adhesion of dry film (waiting times between the two metallization lines are relatively short, causing difficulties in manufacturing).

The new proposed selective metallization process overcomes some of these disadvantages by simultaneously allowing:

- use of a single metallization line;
- total compatibility with subtractive, semi-additive and full additive methods, and their respective laminates;
- use of all types of masks (plating-resists) and, particularly those processable in an aqueous environment;
- assured quality of the final product, which is still dependent on the type of mask used. This dependence is noticed in double sided or multilayer circuit boards.

DESCRIPTION OF THE NEW PROCESS

The new selective metallization process is described in Tables 10, 11 and 12.

Any common technique can be used for cleaning, which is performed before image transfer. Reference to abrasive jets which pumice powder is merely illustrative. The adaptation to multilayer manufacturing techniques (eg. buried via hole) is straight forward and known to a person with ordinary skill in the art.

TABLE 10

Diagram of the manufacturing sequence of double sided printed circuit boards, using the new selective metallization sequence (without desmearing).

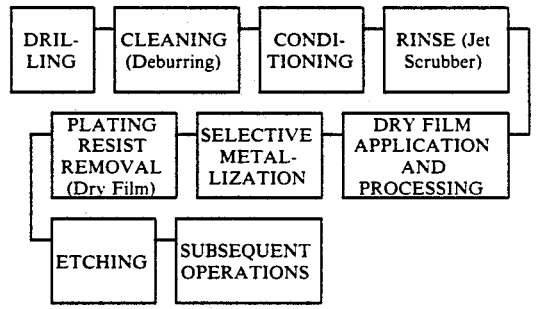

TABLE 11

Diagram of the manufacturing sequence of double sided printed circuit boards, using the new selective metallization sequence (with desmearing)

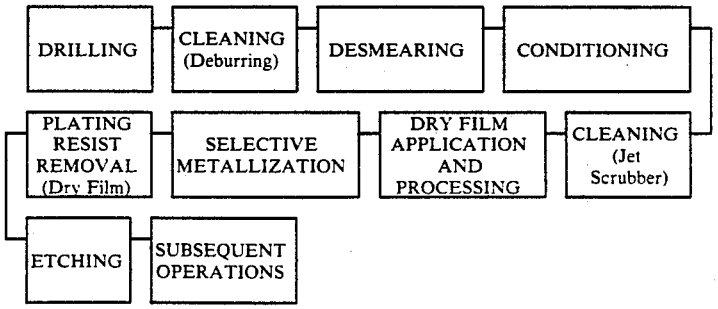

TABLE 12

Simplified diagram of the manufacturing sequence of multilayer printed circuit boards, using the new selective metallization sequence.

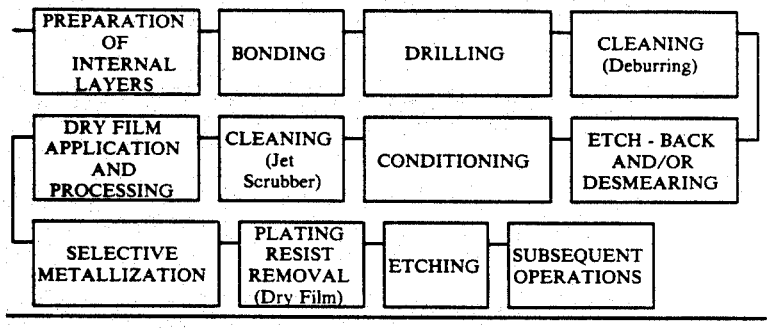

Surface preparation techniques vary according to the type of substrate used (epoxys, polyimide, Teflon, etc.); however, the invention can always be used whatever the substrate since it takes into account the sequence of the process; introduction of conditioning somewhere between drilling and image transfer (Tables 11 and 12) and the sequence and particular characteristics of the metallization.

Therefore, and as a rule, for every example that follows, it's assumed that all the substrates are made of the popular composite fiber glass/epoxy resin. Examples of applications discussed to other substrates will be discussed subsequently.

CONDITIONING IN THE MANUFACTURING OF DOUBLE SIDED PRINTED CIRCUIT BOARDS WITHOUT DESMEARING

This process is described in Table 10. Conditioning is not mandatory, but it is highly recommended. As will be seen in the description of the selective metallization sequence, the first step is degreasing/conditioning, naturally performed in an acid environment. The conditioning performed here is a mild one to ensure catalysis under optimum selective conditions. The metallization sequence, has the ability to neutralize excessive negative charges on the hole surface, induced by drilling. Nevertheless, to ensure full manufacturing quality (regardless of the baths performing outside optimum conditions), the use of a strong conditioner in an alkaline environment, is highly recommended before image transfer.

Almost any type of conditioner and alkaline degreaser/conditioners existent in the market can be used with success, as for example Shipley's Cuposit Conditioner 1160 (trademark) and Cleaner Conditioner 231 (trademark).

Even though these solutions have been designed to work by immersion, they can be adapted to machines with a horizontal conveyor. In any case, all types of conditioners should be tested first, since the spray nozzles can cause uncontrolled foaming. The use of a machine in which the treatment is performed by immersion, preferably to spraying, is recommended. An example of good preparation sequence for the boards after drilling with Shipley's Cleaner Conditioner 231 (trademark) comprises cleaning or deburing the board by use of a machine well known in the art that automatically treats the surface of the board by brushing and directing high pressure water jets against the surface. Next, the cleaned or deburred board is placed in a machine having an immersion conveyer that passes through a solution of the cleaner conditioner i.e. Shipley's Cleaner Conditioner 231 (trademark) and is maintained at a temperature of about 60° C, the immersion time being about five minutes. The board is then removed from the immersion conveyer and cleaned by means of a jet scrubber afterwhich it is dried.

This sequence can easily become automated, all machines working in tandem, for high production levels.

The suppliers should not have any trouble adapting their conditioners to work in any type of machine. They need only change their surfactant formulas for foam control.

CONDITIONING IN THE MANUFACTURING OF MULTILAYER AND DOUBLE SIDED CIRCUIT BOARDS WITH DESMEARING

There are four basic processes used to eliminate the epoxy smear from the hole walls: chromic acid, permanganate, sulphuric acid and plasma. Each one has variants, advantages and inconveniences.

Regarding the new selective metallization process, the preferred desmearing steps usually require an efficient conditioning before image transfer. Without such a conditioning, poor catalysis and consequently imperfect hole coverage can occur.

When desmearing lines are already installed, conditioning can be introduced at the end of the line.

Recommended surface preparation sequences for double side and multilayer circuit boards are shown in Tables 13 and 14:

TABLE 13

Recommended Surface preparation sequences for double sided circiut boards with desmearing.

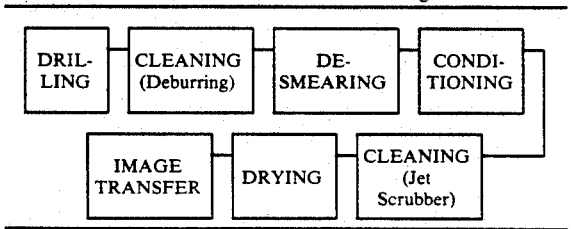

With double sided circuits, conditioning times can vary widely, according to the desmearing procedure and conditioner or degreaser/conditioner used. To obtain optimum metallization results, immersion times in the conditioner could range from about 4 min. to about 30 min.

TABLE 14

Recommended surface preparation sequence for multilayer printed circuit boards.

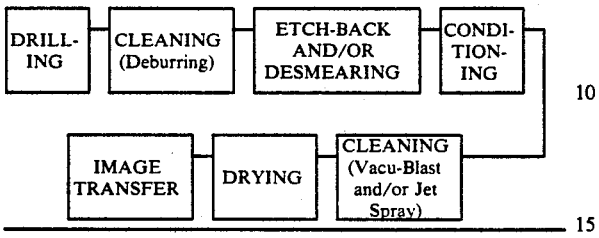

TABLE 15

Diagram showing the metallization sequence of the new selective process

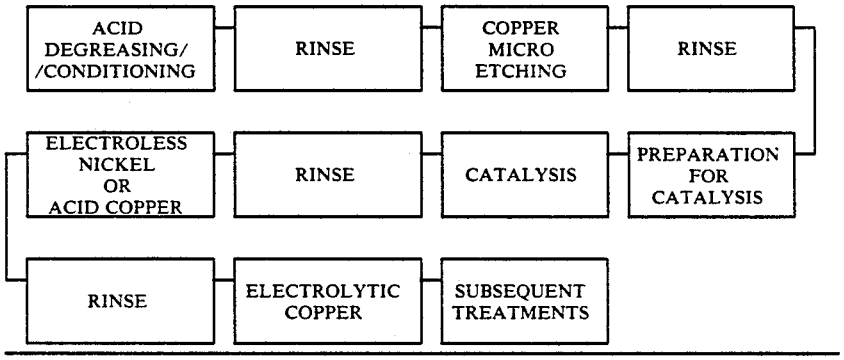

With multilayer printed circuit boards (Table 14) conditioning is processed exactly in the same way. The only difference being that because of the etch-back usually stronger conditioners are required. Depending on the etch-back processors and/or desmearing and on the conditioner chosen, optimum times range from about 5 to about 30 minutes.

DESCRIPTION OF THE METALLIZATION SEQUENCE OF THE NEW SELECTIVE PROCESS

After preparation of the surface, the circuit boards are sequentially immersed in a group of solutions, usually referred to as "selective metallization." This crucial phase is described in Table 15.

Referring to Table 15, a relevant characteristic of this process is its compatibility with all plating-resists used, especially those processable in an aqueous environment. Therefore each step works at a pH lower than 7. Naturally, some steps (e.g. 1 and 8) may contain a moderately alkaline pH when working with the types of Plating-Resists for e.g. RISTON (trademark) I dry films, RISTON (trademark) II and LAMINAR (trademark, Norton Thiokol, Inc.) H or Y. However, the process can be applied universally, based on the selectivity as defined herein only when it is processed in an acid environment.

As shown in Table 15, the selective metallization process leads to a remarkable reduction of the number of operations required, as can be seen by the comparison shown in Table 16.

TABLE 16

Traditional circuit board metallization process vs. the new proposed process.

| NEW PROCESS/TRADITIONAL PROCESS DIFFERENCES |
|---|

TABLE 16-continued

Traditional circuit board metallization process vs. the new proposed process.

| | TRADITIONAL PROCESS | > | NEW PROPOSED PROCESS | |
|---|---|---|---|---|
| 1 | Drilling | | Drilling | 1 |
| 2 | Cleaning | | Cleaning and Pre- | 2 |
| 3 | Alkaline Degreasing | | -Conditioning | 3 |
| 4 | Rinse | | | |
| 5 | Rinse | | Drying | |
| 6 | Copper Microetching | | Plating-Resist Applica- | 4 |
| 7 | Rinse | | tion and Processing | |
| 8 | Activation | | | |
| 9 | Rinse | | Acid Degreasing/Con- | |
| 10 | Pre-Catalysis | | ditioning | 5 |
| 11 | Catalysis | | Rinse | 6 |
| 12 | Rinse | | Copper Micro-Etching | 7 |
| 13 | Rinse | | Rinse | 8 |
| 14 | Accelerator | | Pre-Catalysis | 9 |
| 15 | Rinse | | Catalysis | 10 |
| 16 | Rinse | | Rinse | 11 |
| 17 | Electroless Copper | | Electroless Copper or | |
| 18 | Rinse | | Nickel | 12 |
| 19 | Rinse | | Rinse | 13 |
| | | | Electrolytic Copper | 14 |
| 20 | Drying | | | |
| 21 | Plating-Resist Applica- | | Subsequent Opreations | 15 |
| | tion and Processing | | | |
| 22 | Acid Degreasing | | | |
| 24 | Rinse | | | |
| 25 | Copper Micro-Etching | | | |
| 26 | Rinse | | | |
| 27 | Activation | | | |
| 28 | Rinse | | | |
| 29 | Electrolytic Copper | | | |
| 30 | Subsequent Operations | | | |

SOLUTIONS USED IN SELECTIVE METALLIZATION SEQUENCE

Degreasing/Conditioning

The degreasing and conditioning steps are effected by a bath that can be formulated as degreaser or as a Degreaser/Conditioner. However, in the first case, it might be necessary to create a new conditioning step, before copper micro-etching, which is a disadvantage.

In principle, this operation could be performed with any available acid degreasing/conditioner. However, many available solutions can cause over-conditioning of the delicate surface of the plating-resist destroying the selectivity of the process. Thus, compatibility tests between existing products and the selective process, may have to be preformed in some instances.

The Degreasing/Conditioning solution must be capable of:

a) Removal of greases, dirt and non-developed Plating-Resist residues on the circuit board;

b) Removal of slight oxidation from the copper surface;

c) Attacking glass fibers on the surface of the substrate and silane removal (it is not indispensable, but desirable that the solution be formulated for this purpose);

d) Neutralization of excess negative surface charges existing in substrate resin and in particular on the hole walls. The conditioning must be mild so that the electric equilibrium existent on the plating resist surface is not altered.

The following are two examples of formulations with the same base, the first formulated as degreaser and the second as degreaser/conditioner. The concentrations can be changed over a ±10-15% variance; the concentrations given, however, are the preferred ones.

The degreaser and the degreaser/conditioner formulas that immediately follow in one embodiment employ Antarox (Trademark, GAF) BL 300 as a surfactant and is especially suitable in those formulations although any surfactant selected from the Antarox BL series can be employed. The Antarox BL surfactants are modified linear primary alcohol polyether surface active materials that are sold by GAF corporation.

The Synperonic (trademark ICI) NP-10 utilized in the degreaser/conditioner is a nonionic surfactant comprising an alkyl phenol ethoxylate manufactured by the ethoxylation of p-nonyl phenol with ten repeating ethylene oxide units. Generally, surfactants based on polyalkylene oxide ethers of alkyl phenols may be employed where the alkyl groups contain from about 4 to about 12 carbon atoms and especially about 8 to about 9 carbon atoms including the straight chain and the branch chain isomers thereof but preferably the straight chain configuration, whereas the alkylene oxide group is based on alkylene oxide molecules having from 2 to about 4 and especially 2 or 3 carbon atoms and are repeating units so as to form a polymer chain of sufficient length so as to impart the proper hydrophobic-hydrophillic balance to the surfactant and especially contain anywhere from about 4 to about 40 repeating alkylene oxide units and especially from about 6 to about 20 and preferably from about 9 to about 13 repeating units.

The Basatronic PVI (Trademark, BASF) surfactant used in the degreaser/conditioner is an imidazole derivative of a quaternary ammonium compound.

| Degreaser | |
|---|---|
| Sodium polyphosphate | 30 g/l |
| $Na_2$.EDTA or $Na_4$.EDTA | 1.5 g/l |
| Tripotassium phosphate | 15 g/l |
| Antarox (trademark, GAF) BL300 | 1 g/l |
| Ethoxylated (10 ethoxy) Nonylphenol | 1 g/l |
| Ammonium bifluoride | 1 g/l |
| pH (adjusted with $H_2SO_4$) | 2.5 |
| Temperature | 45° C. |
| Immersion time | about 3 to about 6 min (preferred 5 min) |
| **Degreaser/Conditioner** | |
| Sodium polyphosphate | 30 g/l |
| $Na_2$.EDTA or $Na_4$.EDTA | 1,5 g/l |
| Tripotassium phosphate | 17 g/l |
| Antarox (trademark, GAF) BL300 | 1 g/l |
| Ammonium bifluoride | 1 g/l |
| Synperonic (trademark, ICI) NP-10 | 1 g/l |
| Basotronic (trademark BASF) PVI | 2 ml/l |
| pH (adjusted with $H_2SO_4$) | 2.5 |
| Temperature and immersion time- | identical to Degreaser formulation |

COPPER MICRO-ETCHING

Copper Micro-Etching can be performed with any solution available in the market.

Consequently, persulphate, $H_2SO_4/H_2O_2$ based solutions and other solutions, can be used. Examples of some products that can be used successfully are the following:

-RONETCH PS (Trademark, LEA RONAL)
-PRE-ETCH 746 (Trademark, SHIPLEY)
-PRE-ETCH 748 (Trademark, SHIPLEY)

Proper working conditions will be indicated by the supplier. Immersion times must be adjusted to obtain 0.5 to 1 $\mu$ of copper Microetching.

PREPARATION FOR CATALYSIS (PRE-CATALYSIS) AND CATALYSIS

Step 9 (Pre-Catalysis) is not indispensable, but highly recommended. This step avoids drag-in from previous solutions into the catalyst.

The solutions used, must correspond strictly to the compositions and working conditions present in 3.

ELECTROLESS NICKEL OR COPPER

As verified, the ESCA-XPS results described herein show that there is some palladium over the plating-resist mask which can be found partially in a different oxidation state of the substrates or in the same oxidation state when there is a reduction to Pd°. The adsorption of small palladium concentrations on the plating-resist surface, means that the electroless solution contributes to the selectivity of the process. In fact, the electroless solution must be able to distinguish areas with different oxidations and/or different palladium concentrations. This selectivity ensures successful metallization on clear areas left by removal of the plating-resist mask, without depositing over the plating-resist.

As was previously stated, only electroless reduced hypophosphite, alkylamineboranes, hydrazines and borohydrides baths, respond well to the new proposed catalyst without any reduction step.

Still, the selective process requires that the electroless solution work at an acid pH (preferably <5) in order to extend compatibility to the plating-resists processable in aqueous environment. Under these conditions, the only practical reducers are hypophosphite and alkylamineboranes. The metals of practical interest that can be deposited via electroless in this regard are Ni and Cu. At this point in the new selective process, electroless baths will preferably comprise the four following groups:

-Alkylamineboranes reduced Ni
-Alkylamineboranes reduced Cu
-Hypophosphite reduced Ni
-Bath depositing Cu/Ni alloys

ALKYLAMINEBORANE REDUCED ELECTROLESS NICKEL

Many variants are possible, according to the borane derivative chosen; buffers, chelating agents, stabilizers, concentrations and operating conditions, however, with the selective process, the bath must be selected after compatibility testing is performed, according to the plating-resist used. The following are three examples of these types of electroless baths:

| | | |
|---|---|---|
| Nickel sulphate | 25 g/l | <> Ni metal - 5.2 g/l |
| Succinic Acid | 20 g/l | |
| Dimethylamineborane | 1.2 g/l | |
| 2 ethyl-hexyl-sodium sulphate (40%) | 0.5 ml/l | |
| $Pb(NO_3)_2$ | 2.6 mg/l | |
| or | | |
| Thiourea | 1-2 mg/l | |
| or | | |
| Thiourea derivative (eg. diphenyl thiourea) | 2 mg/l | |
| pH (adjusted with $H_2SO_4$ or NaOH) | 4.5 | |
| Temperature | 65° C. | |

EXAMPLE 5

| | | |
|---|---|---|
| Nickel sulphate | 25 g/l | <> Ni metal - 5.2 g/l |
| Sodium Tetraborate | 10 g/l | |
| Dimethylamineborane | 1.8 g/l to 2 g/l | |
| 2 ethyl-hexyl-sodium sulphate (40%) | 0.5 ml/l | |
| Lead Acetate (II) | 4 mg/l | |
| pH (adjusted with $H_2SO_4$ or NaOH) | 4.5 | |
| Temperature | 60° C. | |

EXAMPLE 6

| | | |
|---|---|---|
| Nickel sulphate | 25 g/l | <> Ni metal - 5.2 g/l |
| Sodium Acetate | 15 g/l | |
| Dimethylamineborane | 2 g/l | |
| 2 ethyl-hexyl-sodium sulphate (40%) | 0.5 ml/l | |
| Lead Acetate (II) | 10 mg/l | |
| pH (adjusted with $H_2SO_4$ or NaOH) | 4.5 | |
| Temperature | 55° C. | |

All the concentrations can be changed about +/−10% without any problems. Some attention is required for the control of the concentrations of dimethylamineborane (which hydrolyzes considerably at the recommended pH) and the stabilizer (lead salt or organic sulphur compound).

The pH can vary from about 4 to about 6, preferably about 4.5 to about 5.0 and the temperature about ±5° C. and preferably about ±2° C.

Example 6 is the preferred formulation for this family of electroless baths, since it can be easily controlled in manufacturing and works at lower temperatures.

Any of the baths work extremely well with other stabilizers, such as:

(a) Other Pb (II) salts or Pb (IV) salts where said salts are based on organic or mineral acids and especially organic acids;

(b) Organic sulphur compounds such as: 2 mercaptobenzothiazol, L-cysteine, and equivalents thereof;

(c) Polysaccharides, such as gelatin and acacia gum (the latter being preferred).

In each case, optimum concentrations must be subjected to tests (particularly with organic sulphur compounds) which is within the skill of the art.

ALKYLAMINEBORANE REDUCED ELECTROLESS COPPER

The following examples show that these baths can be reasonably well stabilized with cyanide additions and at present represent the best mode of this aspect of the invention. The concentration of this stabilizer can reach 30 ppm for solutions that work under heating conditions. Naturally, for obvious reasons, cyanide additions (even small ones) are not recommended for acid baths:

EXAMPLE 7

| | |
|---|---|
| $CuSO_4.5H_2O$ | 2 to about 7 g/l (3 g/l) |
| Quadrol (Trademark; BASF WYANDOTTE) | 50 to about 250 ml/l (150 ml/l) |
| Tert-Butylamineborane | 1 to about 3 g/l (2 g/l) |
| Sodium Cyanide | 0 to about 50 m g/l (20 mg/l) |
| pH (adjusted with $H_2SO_4$) | 3.8 to about 5.5 (4.0) |
| Temperature | Room (20° C.) up to about 40° C. (room) |

The preferred conditions are shown in parentheses.

EXAMPLE 8

Example 8 is identical to Example 7, except for the following changes:

| | |
|---|---|
| Tert-Butylamineborane | 0.5 to about 2 g/l (especially 1 g/l) |
| Dimethylphenantroline | 10 to about 200 mg/l (especially 100 mg/l) |

This example has the advantage of being a more stable solution.

HYPOPHOSPHITE REDUCED ELECTROLESS NICKEL

In this case, many variants are also possible, according to the concentrations and working conditions selected:

EXAMPLE 9

| | |
|---|---|
| Nickel sulphate | 10 to about 50 g/l (25 g/l)<> Ni - 5.2 g/l |
| Ammonium acetate | 5 to about 15 g/l (7.5 g/l) |
| Purified acacia gum | 0.5 to about 4 g/l (2 g/l) |
| Anionic surfactant (eg: 2-ethyl-hexyl-sodium sulphate, solution at 40%) | 0 to about 2 ml/l (0.5 m/1) |
| Lead (as salt, eg: acetate) | 1 to about 7 mg/l (5 mg/l) |
| Sodium hypophosphite | 10 to about 20 g/l (15 g/l) |
| pH (adjusted with $H_2SO_4$ or ammonium hydroxide) | 4.0 to about 5.5 (4.5) |
| Temperature | 60° to about 95° (65° C.) |

The preferred values are shown in parentheses.

EXAMPLE 10

| | |
|---|---|
| Nickel sulphate | 10 to about 50 g/l (25 g/l)<> Ni - 5.2 g/l |
| Ammonium acetate | 1 to about 100 g/l (15 g/l) |
| Sodium citrate | 0 to about 10 g/l (5 g/l) |
| Sodium hypophosphite | 25 to about 40 g/l (32 g/l) |
| Purified acacia gum | 0.5 to about 4 g/l (2 g/l) |
| Non ionic or anionic surfactant (eg: 2-ethyl-hexyl-sodium sulphate, solution at 40%) | 0 to about 2 ml/l (0.5 m/1) |
| Lead (as salt, eg: Pb (II) or (IV) acetate | 1 to about 7 mg/l (5 mg/l) |
| pH (adjusted with $H_2SO_4$ or NaOH) | 4.0 to about 5.5 (4.6) |
| Temperature | 45° to about 70° (55° C.) |

In any of these two examples (hypophosphite reduced electroless nickel), acacia gum can be substituted by other polysaccharides such as various glycogens, gelatin, alginates, etc. However, acacia gum is the easiest to use in selective metallization.

Ni/Cu ELECTROLESS BATHS

The following examples at present represent the best mode for this aspect of the invention.

EXAMPLE 11

The composition of Example 6 has the following components added to it:

| | |
|---|---|
| $CuSO_4.5H_2O$ | 4 g/l |
| Sodium citrate | 20 g/l |
| pH | 4.5 |
| Temperature | 40 to about 50° C. |

EXAMPLE 12

Contrary to Example 11 (dimethylamineborane reduced bath), Example 12 presents a hypophosphite reduced solution:

| | |
|---|---|
| Cu $SO_4.5H_2O$ | 6 g.l |
| Ni $SO_4.7H_2O$ | 0.6 g/l |
| Sodium hypophosphite | 30 g/l |
| Oxalic acid | 12 g/l |
| pH (adjusted with $H_2SO_4$ or NaOH) | 4.5 to about 5.0 |
| Temperature | 60 to about 65° C. |

Surfactants and/or various stabilizers can be added to the compositions of Examples 11 and 12.

As stated previously, there are many nickel, nickel/copper or acid electroless copper formulations, capable of forming the first metallization layer after catalysis, with the catalyst of the invention.

Nevertheless, the preferred embodiments for commercial use are alkylamineboranes and hypophosphite reduced electroless nickels. The following should be noted when using alkylamineboranes:

(a) Alkylamineboranes are much more expensive than sodium hypophosphite (eg: DMAB is about 10 times more expensive than hypophosphite).

(b) Alkylamineboranes are hydrolyzed at a pH of 4.5 to 5.0, consequently, besides high cost they also are subject to instability in the baths.

(c) Alkylamineboranes reduced nickel solutions, in some cases, cause a considerable Ni deposit over laminated copper and consequently some adhesion problems may arise on Cu (laminate)/Ni (deposited)/Cu (deposited) interfaces.

These latter problems are overcome, however, with baking of the coatings after metallization (aprox. 120° C. for 1 h).

The hypophosphite reduced nickels are not subject to hydrolysis, and do not need baking.

For these reasons, hypophosphite reduced nickel compositions are preferred, which are highly reproducible and economical in commercial operations.

HORIZONTAL PROCESSING

All principles, formulations and processing times set forth previously are based on vertical processing of the boards, as is a common practice in circuit board metallization. The new processes and baths set forth herein have been subject to partial testing with horizontal processing. Generally, times tend to diminish dramatically having reached for example, catalysis times of 1 minute.

The new solutions presented, particularly the catalyst, can be used successfully within a wide range of other applications that go beyond circuit boards.

METALLIZATION OF PLASTICS

The metallization of plastics (thermoset and thermoplastic) is mainly a problem of adequate surface preparation, in order to permit a good catalysis and adhesion of the metallic deposits.

Assuming that surface preparation is performed correctly, the new catalysts described herein were tested on several plastics, with complete success and could be applied to plastics in the same way as the prior art catalysts. Among the plastics tested were epoxy, polyurethanes (RIM), PVC, acrylics, polyetheretherketone, PTFE, polyimide, polycarbonate and polyacetal. In some cases, resins with and without fiber glass charges were tested. The metallizations were performed with Ni or Cu or Ni+Cu or Cu+Ni.

The results show that the solutions can be applied to all types of plastics, provided that surface preparation is adequate.

With the new catalysts, selective and non-selective metallization of plastics, render possible the following applications:

(a) Metallization of plastic objects for decorative purposes.

(b) Metallization of equipment parts, boxes, components, etc., made of plastics or composites including those for electromagnetic shielding and/or interference suppression. The possibility of selective metallization is of extreme interest.

(c) Many electroless cobalt-phosphorus and nickel-cobalt phosphorus alloys have good magnetic properties and can be applied by the process of the invention for use in computer memories or magnetic recording media.

(d) Selective or non-selective metallization of circuit boards with any plastic or composite substrates, including plastics. This includes the metallization of injection molded thermoplastic substrates, which is a growing application.

(e) Electroless gold or palladium for use in the electronics industry can be applied by the method of the present invention where a pore free coating is required and similarly nickel-molybdenum-boron and nickel tungsten boron alloys can be deposited as partial or complete replacements for gold in electronic applications.

CERAMIC AND GLASS METALLIZATION

The new catalyst's families were also tested with success, for diverse technical ceramic's metallization.

Specifically, experiments were performed with steatite, alumina, berila, borossilicate glass and GREEN TAPE (Trademark, E.I. DUPONT DE NEMOURS) substrates after hardening. As with plastics, metallization adhesion depends on adequate surface preparation for each case.

The results obtained with the new catalyst, show, that they can be used in selective or non-selective metallization processes, with ceramics or glass substrates.

Examples of possible applications are:

(a) Metallization of ceramic or glass objects for decorative purposes.

(b) Metallization of ceramic or glass parts of equipments for electromagnetic shielding and/or for interference elimination.

(c) Plating of conductors and even some resistors in thick film hybrid manufacturing.

(d) Manufacturing of conductors and resistors in thin film hybrid circuit manufacturing.

SELECTIVE DEPOSITION OF PRECIOUS METALS

Selective deposition via electroless.

The new catalysts render possible selective metallization with several precious metals such as Au, Ag, Pd and Pt.

All electroless baths are possible, but plating-resist masks must be chosen, according to the type, pH and temperature of the solution used. Besides, it might be necessary to add small portions of stabilizers into the electroless baths, in order to ensure perfect selectivity. Such stabilizers can be Pb, Cd, Hg or Sn salts and/or organic compounds containing sulphur, according to the components of the bath.

One application is the selective gold plating of silica pads during the manufacture of integrated circuits. Consequently, it is possible to manufacture gold "pads" used for "wire bonding" of gold or aluminum wires, with a small number of operations. All the formulas can be used for gold plating baths, namely the Okinaka ones, as well as such modifications as Ali and Christie's, with small additions of lead salts (2–10 ppm).

METALLIZATION OF ANODIZED ALUMINUM

As noted before, the new catalysts work at a mild pH e.g. between 4 and 6.5 and therefore, can be used in anodized aluminum metallization processes, whether selective or not.

As known, the anodized layer is chemically quite delicate and will suffer extremely rapid degrading and dissolution if submitted to pH extremes. In principle the anodized layer should not be submitted to pH solutions outside the 4.5–9.5 range. Traditionally, the metallization of anodized aluminum is performed through physical methods (vacuum, sputtering, etc.) or chemical methods such as CVD. The new catalysts, render possible the wet metallization of anodized aluminum, with the additional advantage of permitting a selective metallization (which would not be as easily effected by physical methods or CVD).

For anodized eluminum metallization the following sequence is recommended:

TABLE 17

Anodized aluminum metallization sequence.

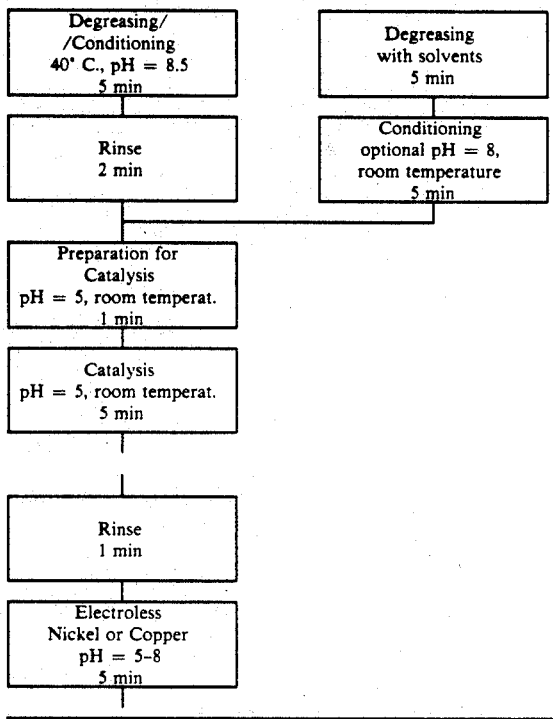

As shown, degreasing can be performed in aqueous solution, or through solvents (chlorinated, chlorofluorinated or others). Although not required, the addition of a cationic surfactant is recommended, based on the conditioning characteristics of the degreaser.

A suggested formula for this degreaser/conditioner is the following:

| | |
|---|---|
| Sodium polyphosphate | 50 g/l |
| Sodium carbonate | 30 g/l |
| EDTA or sodium gluconate | 2 g/l to about 10 g/l |
| Triton X-100 | 2 ml/l |
| Basotronic PVI | 2 ml/l |
| pH (adjusted with $H_2SO_4$) | 8.5 |
| Temperature | Room (20° C.) up to about 45° C. |

The steps for catalysis preparation and catalysis correspond to the compositions previously described herein, however, a pH adjustment between 5.0 and 5.5, that is, slightly higher than with the circuit board substrates, is recommended. The first metallization layer must be deposited with a nickel or copper electroless bath, or another metal, working at a pH range between 5 and 8. The best manufacturing results (in view of costs) were reached with hypophosphite reduced nickel solutions.

Although the invention has been described by reference to some embodiments it is not intended that the novel compositions and processes are to be limited thereby, but that modifications are intended to be included as falling within the spirit and scope of the foregoing disclosure and following claims.

What is claimed is:

1. A catalyst for coating a non-metallic substrate with an electroless or electrolytic metal composition comprising a colloidal oxide of a Group VIII noble metal formed by hydrolysis of a Group VIII noble metal salt, in combination with:

(a) A lower molecular weight organic acid;

(b) A Group IA or Group IIA metal salt of a lower molecular weight organic acid or a halogen acid based on fluorine, chlorine or bromine; and optionally (c) a non-ionic or anionic surfactant, nicotinic acid, coumarine, adenine, guanidine or hydrogen peroxide.

2. The catalyst of claim 1 wherein said Group VIII noble metal is Pd, Pt, Rh or Ir.

3. The catalyst of claim 2 which is a colloidal suspension of an oxide of a Group VIII noble metal at a concentration of from about 0.1 to about 15 g/l, said Group IA or Group IIA salt being present in an amount from about 0.5 to about 150 g/l, the pH of said suspension being from about 3.5 to about 6.5.

4. A method for preparing a catalyst or a catalyst concentrate comprising an oxide of a Group VIII noble metal comprising:

(a) dissolving from about 0.5 to about 150 g/l of a Group IA or Group IIA salt of a lower molecular weight organic acid in water;

(b) adding about 0.1 to about 15 g/l of a salt of Group VIII noble metal to the aqueous solution of step (a), (c) heating the aqueous solution of step (b) at a temperature from about room temperature to about 90° C. for a time sufficient for the solution to acquire a brown reddish color, and (d) after said heating, adjusting the pH of the aqueous solution to a range from about 3.5 to about 6.5 with a lower molecular weight organic acid.

* * * * *